US005294112A

United States Patent [19]

Smith

[11] Patent Number: 5,294,112

[45] Date of Patent: Mar. 15, 1994

[54] BLADDER FOR USE IN A SPORTSBALL

[76] Inventor: Eldon F. Smith, 5911 Princeton-Glendale Rd., Hamilton, Ohio 45011

[21] Appl. No.: 51,897

[22] Filed: Apr. 26, 1993

[51] Int. Cl.[5] ..... A63B 41/08

[52] U.S. Cl. ..... 273/58 BA; 273/65 B; 273/65 ED

[58] Field of Search ..... 273/58 BA, 65 B, 58 B, 273/65 ED, 58 R, 65 R

[56] References Cited

U.S. PATENT DOCUMENTS

| | | | |
|---|---|---|---|
| 3,506,265 | 4/1970 | Yogi | 273/58 BA |
| 4,093,219 | 6/1978 | Pirand | 273/65 B |
| 4,119,592 | 10/1978 | Murphy | 273/65 B |
| 4,258,917 | 3/1981 | Murphy | 273/58 BA |
| 4,462,590 | 7/1984 | Mitchell | 273/65 ED |
| 4,542,902 | 9/1985 | Massino | 273/65 ED |
| 5,181,717 | 1/1993 | Donntag et al. | 273/58 BA |

FOREIGN PATENT DOCUMENTS

| | | |
|---|---|---|
| 668751 | 8/1963 | Canada . |
| 1555634 | 11/1979 | United Kingdom . |

*Primary Examiner*—Vincent Millin
*Assistant Examiner*—Steven B. Wong
*Attorney, Agent, or Firm*—Charles R. Wilson

[57] ABSTRACT

A bladder for use in a sportsball such as a soccer ball or volleyball has good air retention and excellent durability. It is molded to substantially conform to a shape consistent with the shape of the sportsball. The bladder comprises a hollow inner core for holding pressurized air and having an air valve permanently sealed into a wall. At least two bands of a thermoplastic elastomer having a cylindrical shape and dimensioned to fit over the inner core are so positioned and molded under heat and pressure to form the bladder. The first and second bands are positioned over the inner core so as to be at about a 90 degree angle to one another. Any subsequent bands are positioned over the inner core at prescribed angles to the immediately previous band to ensure full coverage of the inner core with the bands.

18 Claims, 3 Drawing Sheets

BLADDER FOR USE IN A SPORTSBALL

This invention relates to a bladder for use in a sportsball. More particularly, the invention relates to a bladder having good air retention and excellent durability which is especially useful in a soccer ball or volleyball.

Many sports use an inflated ball as a necessary part of the game. Soccer, volleyball, basketball and football are examples of very popular sports where a ball is a key component. The ball in at least all the higher levels of play comprises a bladder for holding pressurized air, an air valve for periodically reinflating the ball to a desired level, and a casing for wear protection and/or feel. The ball must be properly shaped and must have proper balance.

Initially, the bladder should be perfectly shaped since a casing of the ball overlying the bladder tends to assume the shape of the bladder unless special processing is undertaken. Wall thickness of the bladder itself must be uniform so as to not create any uneven weight distributions. The more skilled player will readily detect any misshaped or unbalanced ball.

The bladder used in the ball must also be able to hold the pressurized air for prolonged time periods, and oftentimes, under adverse weather conditions. Additionally, the bladder must be able to withstand repeated sharp blows such as from a kick without rupturing or breaking loose from its valve assembly. Abrasion resistance of the bladder is important because of the constant rubbing of the bladder against the inside of the ball's covering during use. Eventually, the bladder can wear thin and rupture. It follows that the bladder must be economical to produce and must be reliable in service.

Bladders for use in sportsballs currently being sold are produced with various materials and in various processes. For example, butyl rubber has been used for many years in soccer ball and football bladders. The bladders are either molded from butyl rubber granules or formed from die-cut butyl rubber sheets. The butyl rubber itself is a good material for bladders because of its excellent air retention. Unfortunately, an air valve assembly which is compatible with the butyl rubber and which is leak-proof has been unattainable. This is due in part because of the physical abuse most sportsballs are subjected to with a consequent flexing of the valve assembly/bladder interface. Bladders made of butyl rubber also tend to rupture prematurely because of the butyl rubber's inherent low abrasion resistance. Bladders have been also produced by a dipping process where a mandrel is dipped into a liquid latex a sufficient number of times to form a solid film of desired thickness. The resultant bladders are very uniform in film thickness. However, the air retention is not good and they tend to rupture easily.

It has been suggested in some literature, including U.S. Pat. Nos. 4,093,219 and 4,119,592 that a rotomolding process can be used to produce a bladder in an economical manner. However, such a process has not been widely adopted by industry because of associated drawbacks, including cost of equipment and slow processing time. Additionally, the resultant bladder has a hard unacceptable feel due to excessive raw material required by the rotomolding process.

There is currently a need for a sportsball bladder which can be produced in an economical fashion and possess all the physical characteristics expected. In accord with this invention, a bladder has been developed which is economically produced. The wall of the bladder is substantially uniform in thickness and is substantially perfectly shaped. Most importantly, the bladder has good air retention and excellent abrasion resistance.

SUMMARY OF THE INVENTION

A bladder for use in a sportsball comprises a hollow inner core for holding pressurized air and a series of thermoplastic elastomeric bands positioned over the inner core and all permanently bonded together. The inner core, with an air valve permanently sealed into a wall, has a shape and size which closely approximates that of the sportsball in which it will be used. The bands have a cylindrical shape and are dimensioned to fit over the inner core when in at least a partially inflated state. A first band is positioned over the inner core and a second band is positioned directly over the first band at an about 90 degree angle to the first band. Subsequent bands are positioned over the inner core at angles to the immediately proceeding band to ensure full and substantially uniform coverage of the inner core by the bands.

A molding step causes the inner core and the bands to permanently bond to one another to form a substantially smooth surfaced and properly shaped bladder.

DETAILED DESCRIPTION OF THE INVENTION

The bladder of this invention is described with particular reference to the drawings. While the description is to a bladder for use in a soccer ball, it should be understood bladders of various shapes and sizes for use in volleyballs, basketballs, water polo balls, footballs, striking bags and the like are also contemplated. The precise shapes and dimensions of the inner core and associated bands for the bladders are readily determined given the physical requirements of the finished ball.

Figure 5:
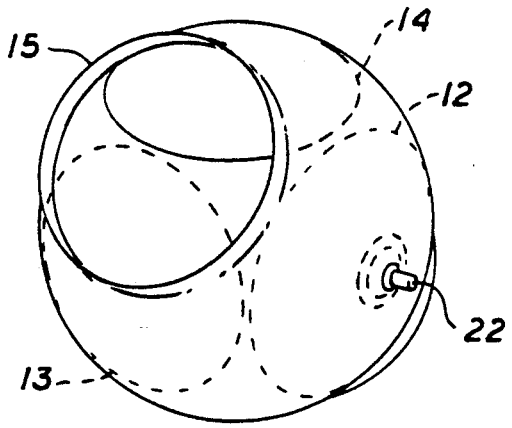
Figure 6:
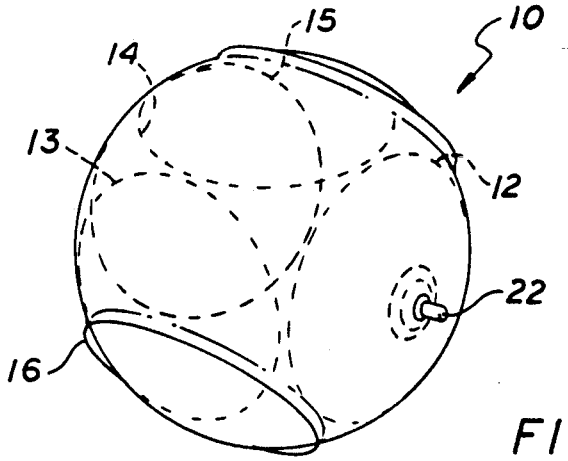
Figure 7:
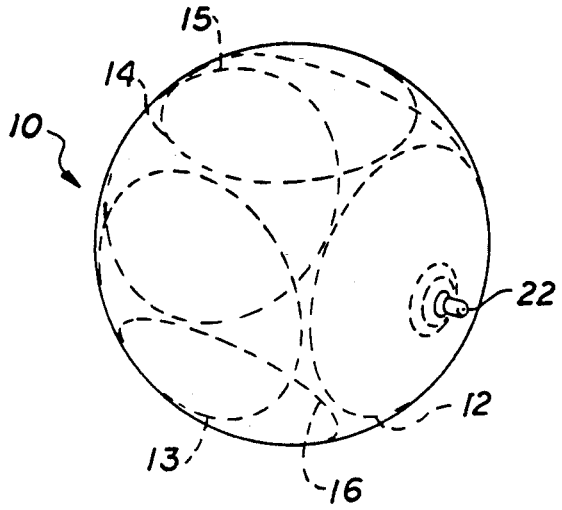
FIG. 7 is a perspective view of the bladder of the invention.

With reference to FIGS. 1–6 there is shown a sequence of steps used in producing a bladder 10 as shown in FIG. 7 for use in a soccer ball. The bladder 10 comprises a hollow inner core 11 and bands 12, 13, 14, 15 and 16 positioned over the inner core in a prescribed manner as further discussed below. The inner core 11 and bands are made of a thermoplastic elastomer, preferably a polyester-based or polyether-based polyurethane. Such elastomers possess certain physical characteristics which make them ideal for use in making a sportsball bladder, especially one used in a sportsball which is likely to be used outdoors under adverse weather conditions. The thermoplastic polyurethane elastomers have good air retention, excellent abrasion resistance, extreme toughness, good low temperature flexibility and excellent moisture resistance. The elastomers also have good thermostability which allow them to be readily processed in extrusion and molding operations. All these characteristics are needed in the bladders of the invention. Other thermoplastic elastomers can be used provided a compromise in quality is acceptable for the contemplated use or level of play. The elastomers are commercially available in powder, pellet and film form.

Figure 1:
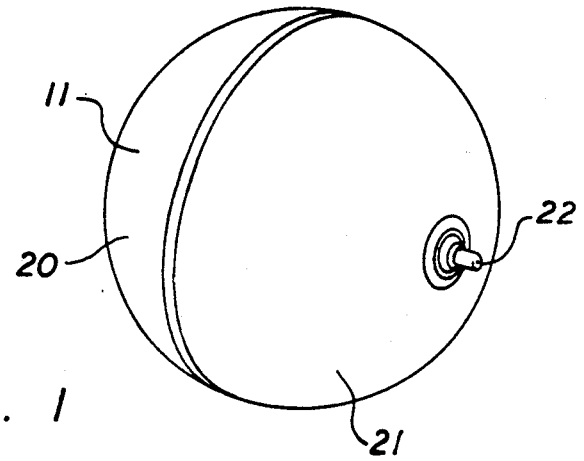
FIGS. 1–6 are successive perspective views of the building of the bladder of the invention showing an inner core in FIG. 1 and the positioning of five separate bands successively around the inner core in FIGS. 2–6.

The inner core 11 of the bladder as best seen in FIG. 1 has a shape and size which approximates that of a soccer ball. It is formed from discs 20 and 21, each of which is die-cut from a film of polyurethane. The film thickness is dictated by the weight limitations specified for the particular bladder. Initially, one of the discs has an air valve permanently sealed to it. Any of several air valves made for this purpose can be used. Highly preferred, however, a valve 22 formed from a thermoplastic polyurethane elastomer is used in the inner core. The polyurethane valve is preferred due to the fact it will permanently bond with the wall of the inner core to ensure its full retention without an air leaking problem. Optimum bonding results from an inner core and an air valve made of the same thermoplastic material.

Figure 8:
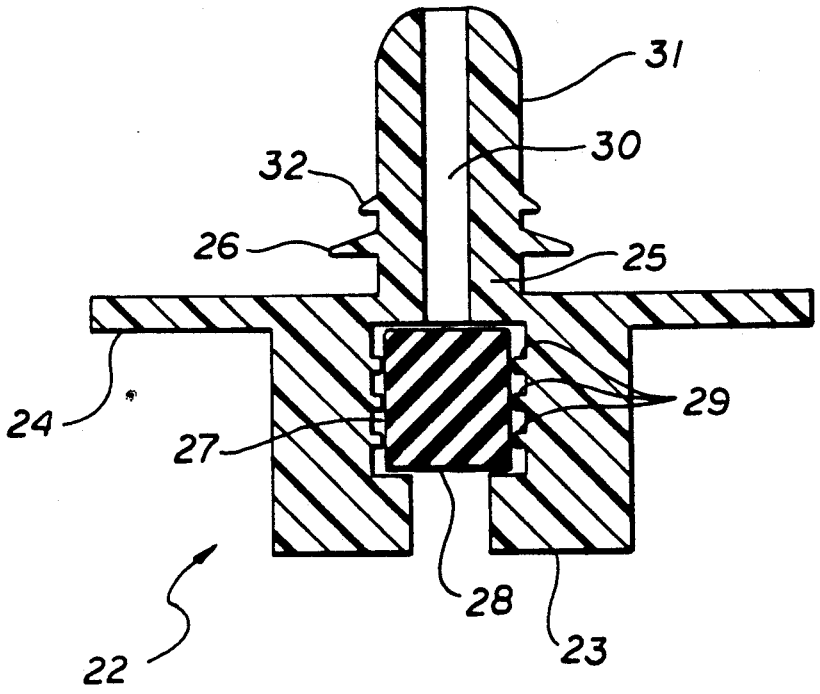
FIG. 8 is a view partially in section of an air valve used in the bladder of FIGS. 1–7.

As depicted in FIG. 8, the air valve 22 has a cylindrical-shaped body 23 with a sealing flange 24, an air passage neck 25 and a snap-in retaining flange 26. The body 23 has a chamber 27 within its central area in which a rubber pellet 28 is placed. The chamber includes a plurality of circumferential flanges 29 which are in compression contact with the pellet 28, securely holding it within the chamber 27. An air passage 30 extends through the neck 25 and through the pellet 28 and is dimensioned to receive an inflation air needle. The pellet is capable of sealing the interior of the bladder from the atmosphere and preventing the air used for inflation of the ball from escaping. The air passage through the pellet is displaced upon insertion of the air needle, though it immediately resumes its shape after the needle is withdrawn to reseal the hole and prevent the escape of air.

When properly positioned in the inner core's wall, the sealing flange 24 of the air valve is located within the interior of the inner core while the retaining flange 26 remains on the exterior of the core. The purpose of the retaining flange is to attach the neck 25 of the air valve to the casing of the ball to ensure that the valve will not be pushed back through the hole in the casing when the air needle is inserted. Thus, the retaining flange secures the air valve in place relative to the outer casing of the ball. A neck extension 31 as shown on the valve 22 is severed between the snap-in retaining flange 26 and a cutting guide flange 32 after the bladder is encased with its casing as discussed below.

The discs 20 and 21 used to form the inner core 11 are sealed together at their peripheries to form a hollow air-tight body. The sealing can be done by the use of adhesives, though a thermal sealing step is very preferred because of the manufacturing ease involved. Necessarily, an overlap of films at the seam area is formed by the sealing process. The inner core 11 can be produced in other manners. For example, it can be produced by a rotomolding process. In all instances, the inner core when inflated has a shape and size which approximates the sportsball in which it will be used and has the air valve permanently sealed in a wall.

Figure 2:
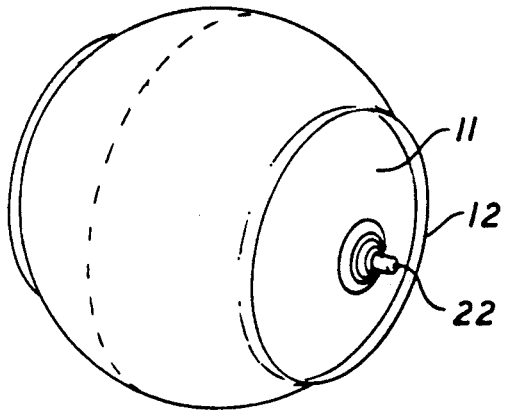

With reference to FIG. 2, a first band 12 is positioned directly over the hollow inner core 11 when it is at least partially inflated so that its walls are fully distended. The band 12 has a cylindrical shape and is dimensioned to slip over the inner core when in the partially inflated state. The length of the band and the diameter of the band are both about equal to the diameter of the inner core when inflated as above mentioned. The diameter of the band and the degree of inner core inflation are finely adjusted so that the band can be readily slipped onto the inner core, yet remain in place during subsequent handling steps. The first band 12 covers a major portion of the inner core 11. In effect, only two poles of the inner core are left uncovered.

Figure 3:
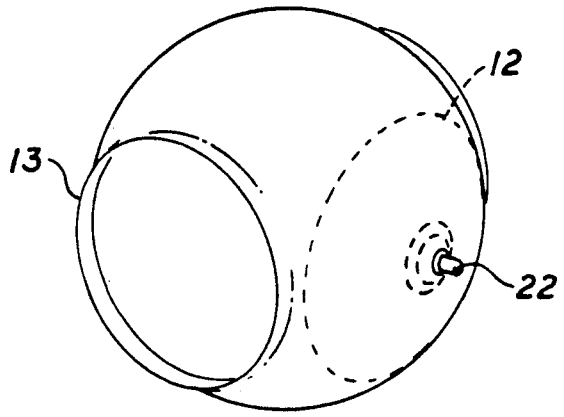

With reference to FIG. 3, a second band 13 is positioned directly over the first band 12 and the inner core 11 at an about 90 degree angle to the first band. The second band 13 thus covers the two poles of the inner core which were left uncovered by the first band 12. The first and second bands collectively cover the inner core 11. The second band as well as any subsequent bands as below discussed all have about the same shape and size as the first band.

The inner core 11 with the two bands 12 and 13 can now be subjected to a molding step to produce a bladder. However, a higher quality bladder with better air retention and more manufacturing tolerance is produced by the addition of one or more bands around the inner core as discussed immediately below.

Figure 4:
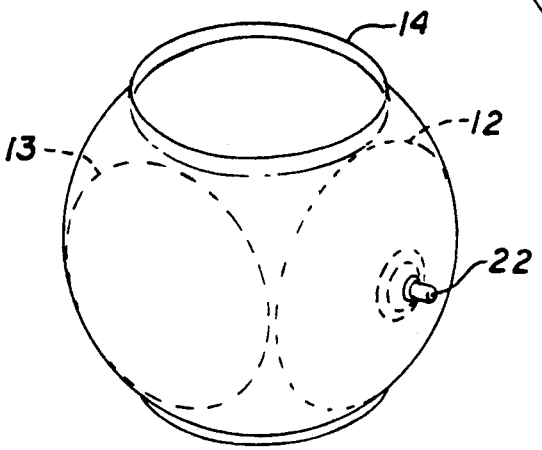

Three additional bands are preferably next added. A third band 14 as depicted in FIG. 4 is positioned directly over the second band so as to be at an about 75 degree to about 105 degree angle thereto. A preferred placement is at about 90 degrees to the second band. A fourth band 15 shown in FIG. 5 is positioned over the third band at an about 30 degree to about 60 degree angle, preferably at about 45 degrees to the third band. Finally, a fifth band 16 as shown in FIG. 6 is positioned over the fourth band at an about 75 degree to about 105 degree angle, preferably at about 90 degrees to the fourth band.

Still additional bands of the same shape and size can be positioned over the inner core in a manner as above described. In all instances, each band is positioned at an angle to the next preceding band to gain added inner core coverage while trying to maintain uniform inner core coverage by the collective bands. The added bands further enhance the air retention of the bladder and its durability, though at a sacrifice in raw material costs and manufacturing speed. It has been found that a bladder with the inner core and from three to seven bands positioned around it as above described has optimum physical characteristics at a reasonable cost. The above described bladder 10 having the inner core 11 and the five bands 12–16 represents an optimum blend of performance and cost and, for this reason, is highly preferred.

The inner core 11 with its attendant bands 12–16 properly positioned is next subjected to a molding step to fuse the core and bands together. A mold comprised of two hemispheres which together form a cavity in the shape and size of the final bladder is used. Means are provided to heat the mold's interior walls. Molds of this type are well known and are manufactured to specification.

After placing the inner core with its bands into the mold and closing it, pressurized air is added to the inner core to cause the core to expand and assume the shape of the mold. The pressurized air also helps to smooth out any wrinkles in the bands. The inner core and bands are then subjected to sufficient temperatures and time to cause them to permanently bond to one another. The thermoplastic nature of the components used in the bladder permit the bonding to readily occur. Generally, the higher the temperature used in the molding step, the lower the residence time needed A temperature of at least about 225 degrees Fahrenheit must be used, though from about 250 degrees to about 300 degrees Fahrenheit is preferred because of the economics of manufacturing. A residence time of from about 30 seconds to about 80 seconds is needed with the preferred temperature range to get a smooth surface bladder substantially fully bonded together.

A bladder having a particularly high quality of appearance and performance is produced when the molds used in the above described method have a non-smooth interior surface. It has been found that a roughened surface, such as found when a ribbed effect, orange peel appearance, or some other texturing is imparted to the mold surfaces, allows air trapped within the bands to more evenly disperse and escape during the molding step. This results in a finished bladder which has a better appearance. It also gives a bladder which performs better because of less trapped air pockets within the bands and more uniform bonding of the bands. While there is some sacrifice in processing efficiency due to a need for longer cycle times, the resultant bladder is of higher quality.

After sufficient processing time has elapsed, the molds are opened and the bladder 10 removed. The resultant bladder composed of the bonded core and bands appears to be a unitized object. The various band edges are discernible only after a close examination.

In an alternative molding method, a heat insulating liner is used in the molds to shorten cycle time. The use of the liner allows the use of higher molding temperatures. This in turn reduces processing time with a consequent increase in productivity. Furthermore, it is theorized that the higher temperatures can cause localized hot spots in an unlined mold which when contacted by the inner core and bands are sufficiently hot to burst the inner core. The heat insulating liner lessens the chances of a hot spot contacting the inner core. Suitable heat insulating liners include woven and non-woven natural fabrics, felts and synthetic fabrics such as Teflon. A secondary advantage realized from the liner is that it also allows the inner core to slide within the mold as it is being expanded by the pressurized air without a problem of sticking to a mold wall. It also allows air trapped between the bands to escape.

The bladder of the invention is given a casing using any known technique. For example, the bladder can be deflated and stuffed into a ball casing, the casing sewn together and finally the bladder reinflated. Alternatively, panels in a lenticular shape can be adhesively secured to the bladder or stitched together to form a full cover.

The sportsball with the bladder has very good air retention and excellent durability. Most importantly, the bladder is substantially perfectly shaped and has substantially uniform wall thickness. This shape ensures that the casing of the sportsball will be perfectly shaped, e.g. round for a soccer ball or volleyball. The bladder of the invention has thus solved an age-old problem which has plagued the industry. Repeated mechanical blows to the sportsball containing the bladder failed to separate the bands or affect the bladder's air retention.

An alternative, though highly preferred bladder of the invention, having both excellent air retention and excellent durability is possible when the inner core and the bands are made from a combination of raw materials designed to optimize the attributes of each. Thus, it is known that a thermoplastic such as saran has excellent air impermeability. An inner core made of the saran and at least two outer bands made of the polyurethane material would result in a bladder having excellent air retention and excellent durability. Other thermoplastic materials in sheet form or as coatings can be used. As readily imagined, still other combinations of raw materials can be used to attain certain defined physical characteristics.

While the invention has been described with particular reference to the drawings, it should be understood various modifications of an obvious nature can be made. All such modifications and changes of a routine nature are considered within the scope of the appended 15 claims.

I claim:

1. A bladder having good air retention and excellent durability for use in a sportsball, said bladder comprising:

(a) a hollow inner core for holding pressurized air having a shape and size when fully inflated which approximates that of the sportsball in which it is used and having an air valve permanently sealed into a wall of said inner core;

(b) a first band having a cylindrical shape and dimensioned to fit over the inner core when at least partially inflated and made of a material bondable to the inner core, said first band positioned directly over the inner core so as to substantially and evenly cover a major portion of the inner core when in an inflated state and permanently bonded thereto; and (c) a second band having a cylindrical shape and dimensioned to fit over the inner core when at least partially inflated and made of a material bondable to the inner core and the first band, said second band positioned directly over the first band at about a 90 degree angle thereto so as to substantially and evenly cover a major portion of the first band and a minor portion of the inner core when in an inflated state and permanently bonded thereto to form the bladder.

2. The bladder of claim 1 further comprising a third band having a cylindrical shape and dimensioned to fit over the inner core when at least partially inflated and made of a material bondable to the second band, said third band positioned directly over the second band at about a 75 degree to 105 degree angle thereto so as to substantially and evenly cover a major portion of the second band and a minor portion of the first band and permanently bonded thereto.

3. The bladder of claim 2 further comprising a fourth band having a cylindrical shape and dimensioned to fit over the inner core when at least partially inflated and made of a material bondable to the third band, said fourth band positioned directly over the third band at about a 30 degree to about a 60 degree angle thereto so as to substantially and evenly cover a major portion of the third band and a minor portion of the second band and permanently bonded thereto.

4. The bladder of claim 3 further comprising a fifth band having a cylindrical shape and dimensioned to fit over the inner core when at least partially inflated and made of a material bondable to the fourth band, said fifth band positioned directly over the fourth band at about a 75 degree to about 105 degree angle thereto so as to substantially and evenly cover a major portion of the fourth band and a minor portion of the third band and permanently bonded thereto.

5. The bladder of claim 4 wherein the inner core and all the bands are made of a thermoplastic elastomer.

6. The bladder of claim 5 wherein the thermoplastic elastomer is a polyurethane.

7. The bladder of claim 6 wherein the polyurethane is an ether base polyurethane.

8. The bladder of claim 6 wherein the polyurethane is an ester based polyurethane.

9. The bladder of claim 8 further wherein the air valve sealed into a wall of the inner core is formed of the same material as the inner core and the bands.

10. The bladder of claim 5 wherein the inner core is formed from two disc-shaped films which have been sealed together at their peripheries.

11. The bladder of claim 1 shaped and dimensioned for use in a soccer ball.

12. The bladder of claim 1 shaped and dimensioned for use in a volleyball.

13. A method of building a bladder having good air retention and excellent durability for use in a sportsball comprising the steps of:

(a) forming an inner core having a shape and size when fully inflated which approximates that of the sportsball and having an air valve permanently sealed into a wall of said inner core;

(b) partially inflating the inner core to distend the wall of the inner core;

(c) positioning a first band having a cylindrical shape directly over the partially inflated inner core so as to substantially and evenly cover a major portion of the inner core, said first band being capable of bonding to the inner (d) positioning a second band having a cylindrical shape directly over the first band at about a 90 degree angle thereto so as to substantially and evenly cover a major portion of the first band and a minor portion of the inner core, said second band being capable of permanently bonding to the first band and the inner core;

(e) placing the inner core with the first and second bands positioned thereon in a mold having the approximate shape and size of the sportsball;

(f) fully inflating the inner core to cause its wall to distend outwardly such that the bands on the exterior of the inner core contact the inner surface of the mold in a substantially uniform manner; and (g) molding the inner core with the bands thereon at a temperature and time sufficient to permanently bond the inner core and the bands together to form a substantially perfectly shaped bladder.

14. The method of claim 13 further comprising positioning a third band having a cylindrical shape directly over the second band at about a 75 degree to about 105 degree angle thereto so as to substantially and evenly cover a major portion of the second band and a minor portion of the first band, said third band being capable of permanently bonding to the first and second bands.

15. The method of claim 14 further comprising positioning a fourth band having a cylindrical shape directly over the third band at about a 30 degree to about 60 degree angle thereto so as to substantially and evenly cover a major portion of the third band and a minor portion of the second band, said fourth band being capable of permanently bonding to the second and third bands.

16. The method of claim 15 further comprising positioning a fifth band having a cylindrical shape directly over the fourth band at about a 75 degree to about 105 degree angle thereto so as to substantially and evenly cover a major portion of the fourth band and a minor portion of the third band, said fifth band being capable of permanently bonding to the third and fourth bands.

17. The method of claim 13 wherein the mold has a roughened interior surface to allow air trapped within the bands to more evenly disperse and escape during the molding step.

18. The method of claim 17 wherein the inner core and bands are subjected to a temperature of from about 225 degrees to about 300 degrees Fahrenheit for about 30 seconds to about 80 seconds in the molding step.

* * * * *